US006883727B2

(12) United States Patent
De Los Santos

(10) Patent No.: US 6,883,727 B2
(45) Date of Patent: Apr. 26, 2005

(54) ROTATING STREAM SPRINKLER WITH BALL DRIVE

(75) Inventor: Lino De Los Santos, Walnut, CA (US)

(73) Assignee: Rain Bird Corporation, Glendora, CA (US)

( * ) Notice: Subject to any disclaimer, the term of this patent is extended or adjusted under 35 U.S.C. 154(b) by 15 days.

(21) Appl. No.: 10/644,611

(22) Filed: Aug. 19, 2003

(65) Prior Publication Data

US 2005/0040256 A1 Feb. 24, 2005

(51) Int. Cl.[7] ..... B05B 3/04; B05B 1/30

(52) U.S. Cl. ..... 239/240; 239/237; 239/241; 239/580

(58) Field of Search ..... 239/240, 237, 239/241, 580, 201, 203, 204, 206, 230, 252, 239/380, 381, 463, 465, 498, 521, 523, DIG. 1

(56) References Cited

U.S. PATENT DOCUMENTS 4,660,766 A 4/1987 Nelson et al.
4,781,328 A 11/1988 Robertson
4,784,325 A * 11/1988 Walker et al. ..... 239/204
4,796,811 A 1/1989 Davisson
4,815,662 A 3/1989 Hunter
4,944,456 A * 7/1990 Zakai ..... 239/222.19
4,971,250 A 11/1990 Hunter
4,986,474 A 1/1991 Schlisler et al.
5,058,806 A 10/1991 Rupar
RE33,823 E 2/1992 Nelson
5,288,022 A 2/1994 Sesser
5,845,849 A 12/1998 Mitzlaff
5,984,203 A * 11/1999 Rosenberg ..... 239/222.11
5,984,205 A * 11/1999 Rosenberg ..... 239/233
6,244,521 B1 6/2001 Sesser

* cited by examiner

*Primary Examiner*—David A. Scherbel
*Assistant Examiner*—Darren Gorman
(74) *Attorney, Agent, or Firm*—Fitch, Even, Tabin & Flannery

(57) ABSTRACT

A rotating stream sprinkler of the type having a rotatable vaned deflector for stepwise sweeping of relatively small water streams over surrounding terrain to irrigate adjacent vegetation. The sprinkler includes a turbine driven ball drive rotor having at least one drive ball carried by centrifugal force into repetitious impact engagement with one or more raised anvils on the deflector for incrementally displacing the deflector in a succession of small rotational steps. A speed control brake includes a brake pad interposed between a friction surface on the deflector and a nonrotating brake disk to provide a variable friction force to maintain deflector rotation substantially constant within a range of normal water supply pressures and flow rates.

41 Claims, 7 Drawing Sheets

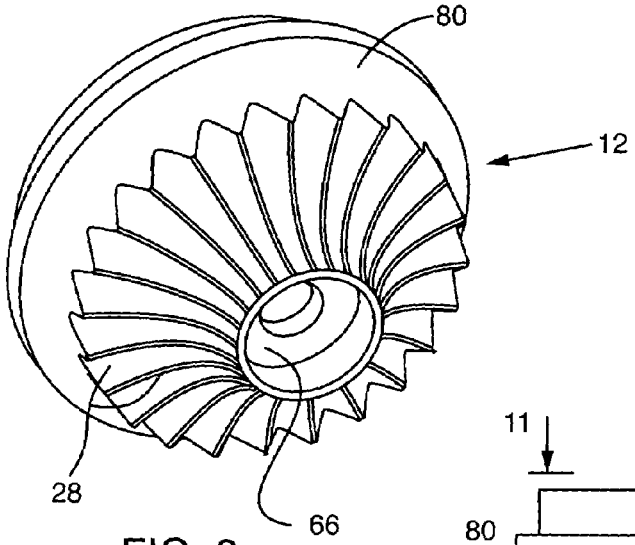
FIG. 8
FIG. 9
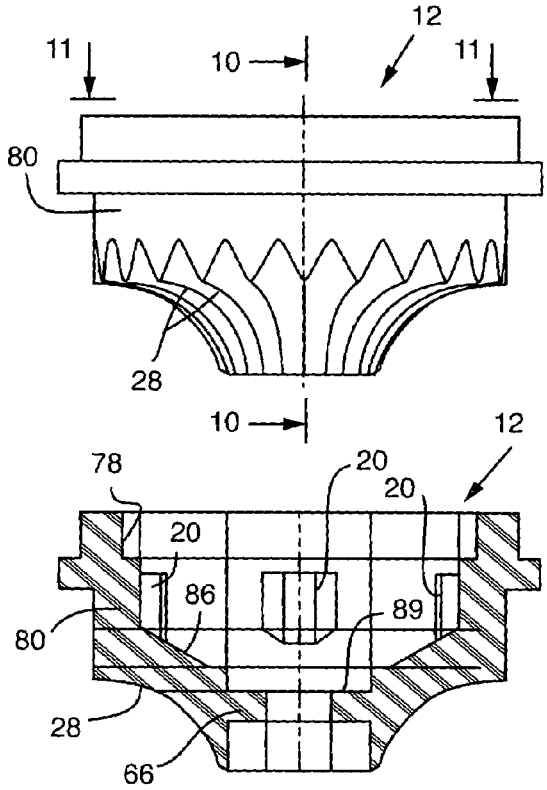
FIG. 10
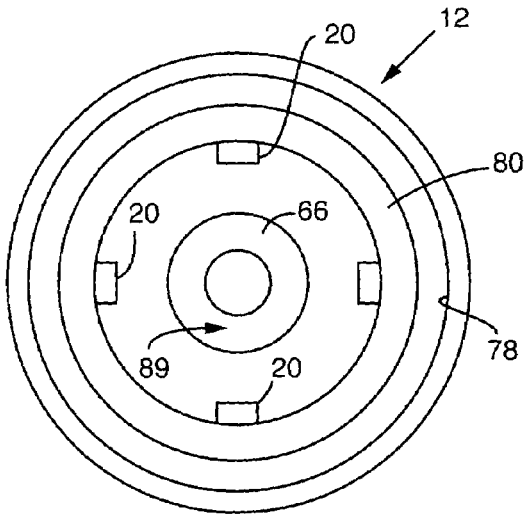
FIG. 11

ROTATING STREAM SPRINKLER WITH BALL DRIVE

BACKGROUND OF THE INVENTION

This invention relates generally to improvements in irrigation sprinklers of the so-called micro-stream type having a rotatably driven vaned deflector for sweeping a plurality of relatively small water streams over a surrounding terrain area to irrigate adjacent vegetation. More specifically, this invention relates to an improved rotating stream sprinkler having a ball drive rotor for rotatably driving the deflector in a succession of relatively small angular increments or steps, in combination with a speed control brake for maintaining the rotational speed of the vaned deflector substantially constant throughout a range of normal operating pressures and flow rates.

Rotating stream sprinklers, sometimes referred to as micro-stream sprinklers, are well known in the art of the type for producing a plurality of relatively small outwardly projected water streams swept over surrounding terrain. In one common form, one or more jets of water are directed upwardly against a rotatable vaned deflector which has a vaned lower surface defining an array of relatively small flow channels extending upwardly and turning radially outwardly with a spiral component of direction. The water jet or jets impinge upon this underside vaned deflector surface to fill these curved flow channels and to rotatably drive the deflector. At the same time, the water is guided by the curved flow channels for projection generally radially outwardly from the sprinkler in the form of a plurality of relatively small water streams to irrigate adjacent vegetation. As the deflector is rotatably driven, these water streams are swept over the surrounding terrain area, with a range of throw depending in part on the channel configuration. Such rotating stream sprinklers have been designed for irrigating a surrounding terrain area of predetermined pattern, such as a full circle, half-circle, or quarter-circle pattern. For examples of such rotating stream sprinklers, see U.S. Pat. Nos. 4,660,766; 4,796,811; 4,815,662; 4,971,250; 4,986,474; Re. 33,823; 5,288,022; 5,058,806; 5,845,849; and 6,244,521.

In rotating stream sprinklers of this general type, it is desirable to control or regulate the rotational speed of the vaned deflector and thereby also regulate the speed at which the water streams are swept over the surrounding terrain area. In this regard, in the absence of speed control or brake means, the vaned deflector can be rotatably driven at an excessive speed up to and exceeding 1,000 rpm, resulting in rapid sprinkler wear and distorted water stream delivery patterns. A relatively slow deflector rotational speed on the order of about 4–20 rpm is desired to achieve extended sprinkler service life while producing uniform and consistent water stream delivery patterns. Toward this end, a variety of fluid brake devices have been developed wherein a rotor element carried by the vaned deflector is rotatably driven within a closed chamber containing a viscous fluid. In such designs, the viscous fluid applies a substantial drag to rotor element rotation which significantly reduces the rotational speed of the vaned deflector during sprinkler operation.

While such fluid brake devices are effective to prevent deflector rotation at excessive speeds, the actual rotational speed of the deflector inherently and significantly varies as a function of changes in water pressure and flow rate through the sprinkler. Unfortunately, these parameters can vary during any given period or cycle of sprinkler operation, resulting in corresponding variations in the water stream delivery patterns for irrigating the surrounding vegetation. In addition, such fluid brake concepts require the use and effective sealed containment of a viscous fluid such as a silicon-based oil or the like, which undesirably increases the overall complexity and cost of the irrigation sprinkler.

Copending U.S. Ser. No. 10/310,584, filed Dec. 4, 2002, discloses an improved rotating stream sprinkler having a nonfluid speed control brake for maintaining the rotational speed of the vaned deflector substantially constant throughout a range of normal operating pressures and flow rates. A resilient brake pad is mounted between a friction plate rotatable with the deflector and a nonrotating brake disk, with one or more of these components incorporating a suitably tapered contact surface designed for varying the frictional resistance to deflector rotation in a manner achieving substantially constant rotational speed during normal operating conditions. While this improved sprinkler design beneficially avoids the problems and disadvantages associated with prior fluid brake concepts, the deflector is continuously rotated to sweep the water streams over the surrounding terrain to be irrigated. Such continuous rotation of the deflector inherently reduces the range of throw of the outwardly projected water streams.

There exists, therefore, a need for further improvements in and to rotating stream sprinklers of the type for sweeping a plurality of relatively small water streams over a surrounding terrain area, particularly with respect to maximizing the range of the outwardly projected water streams while at the same time maintaining the rotational speed of a vaned deflector at a controlled, relatively slow, and substantially constant rate. The present invention fulfills these needs and provides further related advantages.

SUMMARY OF THE INVENTION

In accordance with the invention, a rotating stream sprinkler is provided of the type having a rotatable vaned deflector for sweeping a plurality of relatively small water streams over a surrounding terrain area to irrigate adjacent vegetation. The sprinkler includes a turbine driven ball drive rotor having at least one drive ball carried by centrifugal force into repetitious impact engagement with one or more raised anvils on the deflector for incrementally displacing the deflector in a succession of small rotational steps. The sprinkler further includes a speed control brake for providing a variable friction force resisting deflector rotation, to maintain deflector rotation substantially constant within a range of normal water supply pressures and flow rates.

The rotating stream sprinkler comprises the vaned deflector rotatably mounted above a sprinkler base and having an underside surface defined by an array of vanes with generally vertically oriented upstream ends which curve and merge smoothly with generally radially outwardly extending downstream ends. These vanes cooperatively define a corresponding array of intervening, relatively small flow channels of corresponding configuration. One or more water jets, directed upwardly through jet ports formed in a pattern plate on the sprinkler base, impinge upon these deflector vanes and are subdivided into a plurality of relatively small water streams flowing through said flow channels for projection radially outwardly from the sprinkler to irrigate the surrounding terrain area. The specific pattern of irrigated terrain area is determined by the pattern of jet ports formed in the pattern plate to provide, for example, a substantially full circle, half-circle, or quarter-circle irrigation pattern.

The ball drive rotor includes at least one and preferably multiple drive balls carried within radially outwardly open slotted tracks, with the drive balls supported on a radially outwardly inclined ramp defined on an upper surface of the deflector. A turbine is rotatably driven by a swirling water flow passed through an array of angularly oriented swirl ports formed in a swirl plate, and the turbine in turn rotatably drives the rotor at a speed sufficient to displace the drive balls radially outwardly within their respective slotted tracks and upwardly on the inclined ramp by centrifugal action. The drive balls are thus displaced by centrifugal force into impact engagement with one or more anvils protruding radially inwardly from an upstanding, generally cylindrical wall on the deflector at the periphery of the inclined ramp.

Impact engagement between one of the drive balls and one of the anvils on the deflector wall causes the deflector to rotate through a relatively small angular step or increment, whereupon the deflector ceases rotation for a brief interval until the next impact engagement between a drive ball and anvil. During this brief interval, the water streams are projected outwardly from the stationary deflector with a maximum radius of throw. In addition, the drive ball is impact-displaced radially inwardly a sufficient distance to permit continued turbine driven rotation of the ball drive rotor, followed by return movement of the drive ball in a radially outward direction by centrifugal action for subsequent impact engagement with the same or a different one of the anvils on the deflector. Thus, the drive balls are carried by centrifugal force for impact engagement with the drive anvils in a rapid and repetitious succession to correspondingly rotate the deflector through a rapid succession of small rotational steps.

The speed control brake, in the preferred form, includes a brake pad interposed axially between an upwardly presented friction surface on the deflector and a nonrotating brake disk. Upon supply of water through the pattern plate jet ports to impinge upon the deflector vanes, the deflector is urged axially upwardly to compress the brake pad between the deflector friction surface and the brake disk, thereby generating frictional resistance to deflector rotation. The speed control brake is preferably designed in accordance with copending U.S. Ser. No. 10/310,584, filed Dec. 4, 2002, which is incorporated by reference herein, to provide a variable frictional resistance to maintain deflector rotational speed substantially constant within a range of normal water supply pressures and flow rates.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings:

FIG. 8 is an underside perspective view of a vaned deflector;

FIG. 9 is a side elevation view of the vaned deflector of FIG. 8;

FIG. 10 is a vertical sectional view taken generally on the line 10—10 of FIG. 9;

FIG. 11 is a top plan view of the vaned deflector, taken generally on the line 11—11 of FIG. 9;

DETAILED DESCRIPTION OF THE PREFERRED EMBODIMENT

Figure 1:
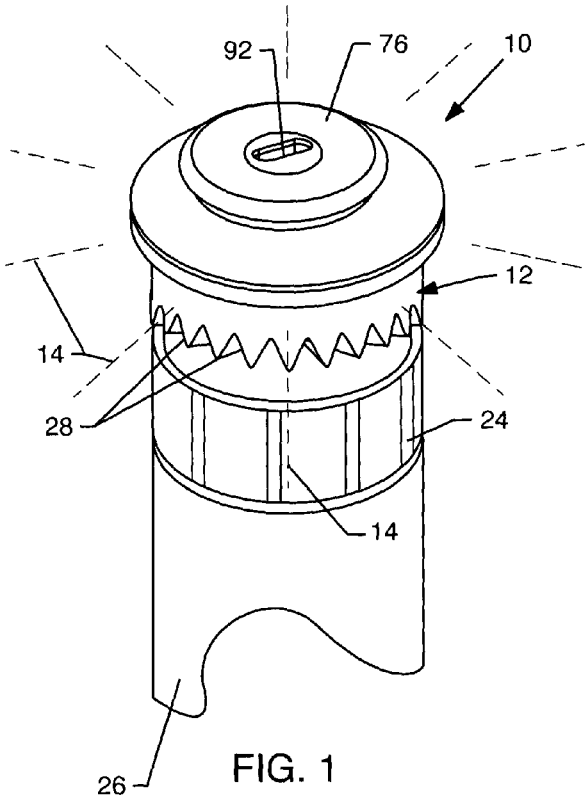
FIG. 1 is a fragmented perspective view illustrating a rotating stream sprinkler of the present invention installed onto the upper end of a riser.

As shown in the exemplary drawings, a rotating stream sprinkler referred to generally in FIGS. 1–4 by the reference numeral 10 includes a vaned deflector 12 for producing and distributing a plurality of relatively small water streams 14 (FIG. 1) projected radially outwardly therefrom to irrigate a surrounding terrain area. The deflector 12 is rotatably indexed in a rapid succession of relatively small angular steps or increments by a turbine driven ball drive rotor 16 (FIGS. 3, 4 and 12–14) including one or more drive balls 18 for repetitious impact engagement with one or more anvils 20 carried by the deflector. A speed control brake 22 (FIG. 3) is additionally provided to maintain the rotational speed of the deflector 12 at a controlled, relatively slow, and substantially constant speed throughout a range of normal operating pressures and flow rates.

Figure 2:
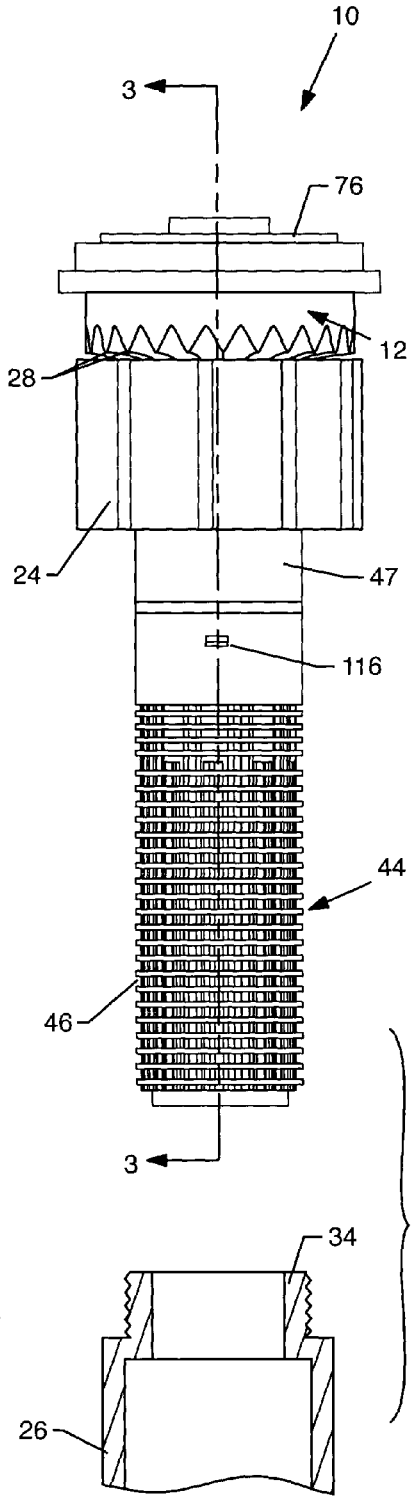
FIG. 2 is a side elevation view of the rotating stream sprinkler viewed in FIG. 1, shown in exploded relation with the riser depicted in partial section.

The rotating stream sprinkler 10 of the present invention generally comprises a compact sprinkler nozzle unit or head having a base 24 adapted for convenient thread-on mounting or the like onto the upper end of a stationary or pop-up tubular riser 26 (FIGS. 1–2). The deflector 12 is rotatably supported on the base 24 and includes an underside surface defining an array of vanes 28 (FIGS. 1–4, 8 and 9) for projection of the plurality of relatively small water streams 14 (FIG. 1) radially outwardly from the deflector 12 to irrigate surrounding vegetation. The ball drive rotor 16 is rotatably driven by a turbine 30 (FIG. 3) for carrying the drive ball or balls 18 by centrifugal action into repeated impact engagement with the anvil or anvils 20 (FIGS. 3, 10 and 11) to rotatably drive the deflector in a succession of small rotational steps, thereby sweeping the outwardly projected water streams 14 in a stepwise fashion over the surrounding terrain. The speed control brake 22 provides a variable frictional resistance to deflector rotation for purposes of maintaining deflector rotational speed at a relatively slow and substantially constant rate of about 4–20 rpm, throughout a normal range of water supply pressures and flow rates. Accordingly, the improved sprinkler 10 beneficially provides a consistent and uniform pattern of water distribution during each operating cycle, with deflector rotation momentarily halting after each rotational step to permit the projected water streams 14 to achieve a substantially maximized range of throw.

Figure 7:
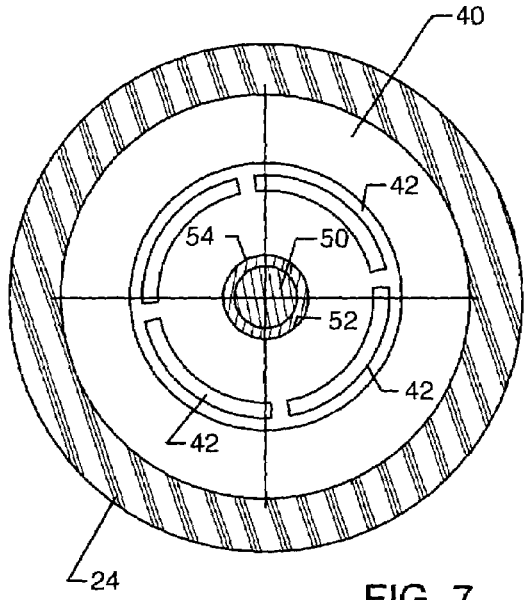
FIG. 7 is a horizontal sectional view taken generally on the line 7—7 of FIG. 3.

More particularly, as shown in FIGS. 1–4 in accordance with one preferred form of the invention, the sprinkler base 24 has a generally cylindrical shape with an internal female thread 32 (FIG. 3) formed within a lower region thereof for convenient and simple mounting of the base 24 onto an externally threaded upper end 34 (FIG. 2) of the tubular riser 26. An internal, radially inwardly projecting annular rib 36 (FIG. 3) is formed within the base 24 to define a downwardly presented annular shoulder for seated support and retention of a circular pattern plate 40 which may be attached to the base 24 as by means of a suitable adhesive, or by a weld process such as ultrasonic welding. Alternatively, the pattern plate 40 may be formed integrally with the base 24, as by plastic injection molding or the like. As viewed best in FIG. 7, the pattern plate 40 has an array of upwardly open jet ports 42 formed therein in an annular pattern, with the illustrative drawings showing four elongated arcuate ports 42 each spanning an arcuate range of slightly less than 90° for substantially full-circle distribution of water from the sprinkler during operation, as will be described in more detail. Persons skilled in the art will recognize and appreciate that the number and geometry of these jet ports 42 can be varied for selected part-circle water distribution, such as a quarter-circle, half-circle, or other selected part-circle irrigation pattern.

A filter unit 44 having an upwardly open and generally cup-shaped configuration is mounted at the underside of the sprinkler base 24. In one form, this filter unit includes an outwardly radiating upper flange 48 having a size and shape for press-fit or snap-fit reception into the underside of the base 24, with a generally cylindrical side wall suspended therefrom. In an alternative form, the filter unit 44 may be configured for slide-fit reception into the open upper end of the riser 26, with the flange 48 rested upon the riser upper end, prior to thread-on mounting of the base 24. In either configuration, the cylindrical side wall of the filter unit 44 is slidably received into the riser upper end and has a perforated lower segment 46. This perforated lower segment 46 of the filter unit 44 is sufficiently spaced from an internal diameter surface of the riser 26 so that water inflow to the sprinkler 10 may pass through the perforations which obstruct passage of sizable particulate and other debris which could other damage sprinkler components.

Figure 5:
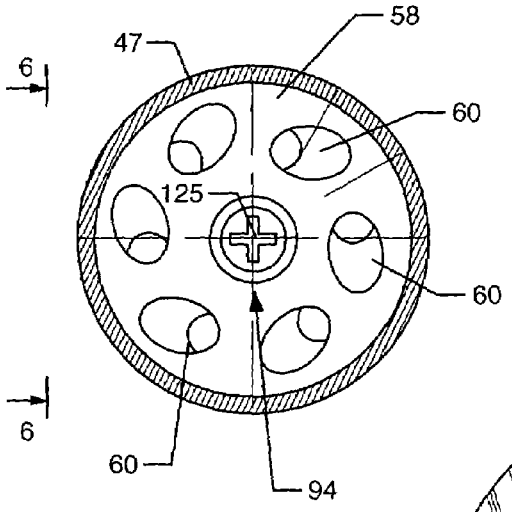
FIG. 5 is a horizontal sectional view taken generally on the line 5—5 of FIG. 3.
Figure 6:
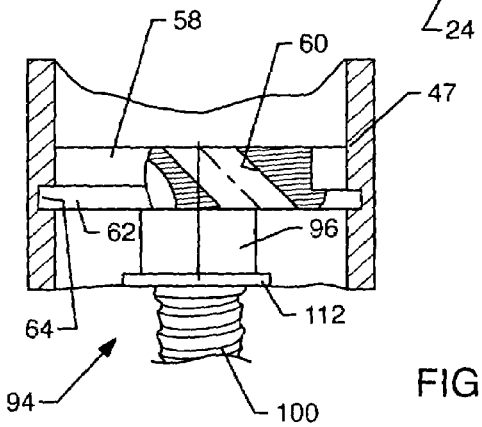
FIG. 6 is an enlarged fragmented side elevation view taken generally on the line 6—6 of FIG. 5, with portions broken away to illustrate construction details of an internally mounted swirl plate.

The turbine 30 is mounted at a lower end of a drive shaft 50 extending downwardly through a central aperture 52 formed in the pattern plate 40. This drive shaft 50 is rotatably carried within a tubular bearing sleeve 54, a lower end of which extends downwardly through the pattern plate 40 and is captured by a shaft seal 56. The turbine 30 is mounted onto the drive shaft 50 as by press-fit or snap-fit mounting thereon, to position the turbine within an upper region of the filter unit 44 in the path of upward water flow to the sprinkler 10, when the riser 26 is connected to a supply of water under pressure. A swirl plate 58 is positioned within a substantially imperforate upper segment 47 of the cylindrical side wall of the filter unit 44, at an upstream location relative to the turbine 30, and includes an annular array of angularly oriented swirl ports 60 (shown best in FIGS. 5–6) for imparting a circumferential swirl flow to water inflow passing through the riser 26 to the sprinkler 10 to rotatably drive the turbine 30 and the associated drive shaft 50. As shown, the swirl plate 58 may include a peripheral ridge 62 (FIG. 6) for snap-fit mounting into a matingly shaped internal groove 64 formed within the imperforate upper segment 47 of the filter unit 44.

The drive shaft 50 and the associated bearing sleeve 54 project upwardly from the pattern plate 40 for rotatably supporting the deflector 12, and for rotatably driving the ball drive rotor 16 on the same axis but independently of deflector rotation. More specifically, the bearing sleeve 54 extends upwardly through a central hub 66 of the deflector 12, and supports this deflector hub 66 in an axial position sandwiched between a lower seal member 68 and a radially enlarged thrust flange 70 at the upper end of the bearing sleeve 54. With this arrangement, the deflector 12 is supported on the exterior of the bearing sleeve 54 for rotation relative to said bearing sleeve, whereas the drive shaft 50 is supported within the bearing sleeve 54 for rotation relative to said bearing sleeve. The bearing sleeve 54 is supported by secure, nonrotational connection to the pattern plate 40.

The deflector 12, which may be conveniently formed from lightweight molded plastic, incorporates the array of vanes 28 formed on an underside surface thereof. This array of vanes is disposed, as previously described, for engagement by the jet or jets of water flowing upwardly from the pattern plate 40, in accordance with the number and configuration of jet ports 42 formed in the pattern plate. These vanes 28 (shown best in FIGS. 8–9) are shown to have a generally V-shaped cross section defining a corresponding plurality of intervening flow channels of inverted generally V-shaped cross section extending upwardly and then curving smoothly to extend generally radially outwardly with a selected inclination angle. In the preferred form, these vanes 28 and the associated flow channels do not incorporate any significant spiral or helical component of direction. In operation of the sprinkler, the upwardly directed water jet or jets from the pattern plate 40 impinge upon the lower or upstream segments of these vanes 28 which subdivide the water flow into the plurality relatively small flow streams 14 for passage through the flow channels and radially outward projection from the sprinkler. With the pattern plate jet ports 42 arranged in a substantially full-circle array as shown (FIG. 7), the resultant water jets impinge upon the array of deflector vanes 28 for substantially full-circle distribution of water streams 14 from the sprinkler. Alternative jet port arrangements in the pattern plate 40, such as quarter-circle or half-circle arrangements (not shown) will produce a corresponding part-circle impingement of water upon the deflector vanes 28 for part-circle distribution of water streams 14 from the sprinkler. By forming the vanes 28 and the associated flow channels without a significant spiral or helical configuration, the water jet or jets impinging on the vanes do not impart any significant rotary drive torque to the deflector 12.

Figure 12:
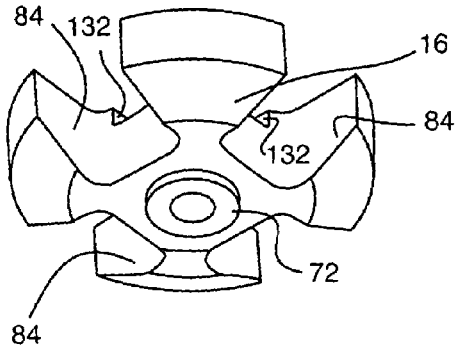
FIG. 12 is an underside perspective view of a ball drive rotor forming a portion of a ball drive arrangement for the rotating stream sprinkler.
Figure 14:
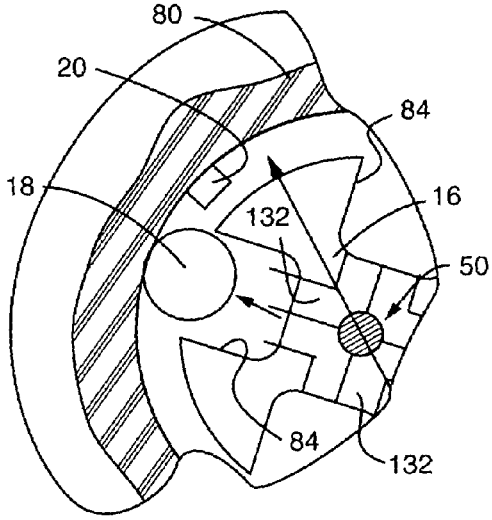
FIG. 14 is a fragmented horizontal sectional view, similar to a portion of FIG. 13, and illustrating impact engagement of a drive ball with a radially inwardly protruding anvil on the vaned deflector.
Figure 13:
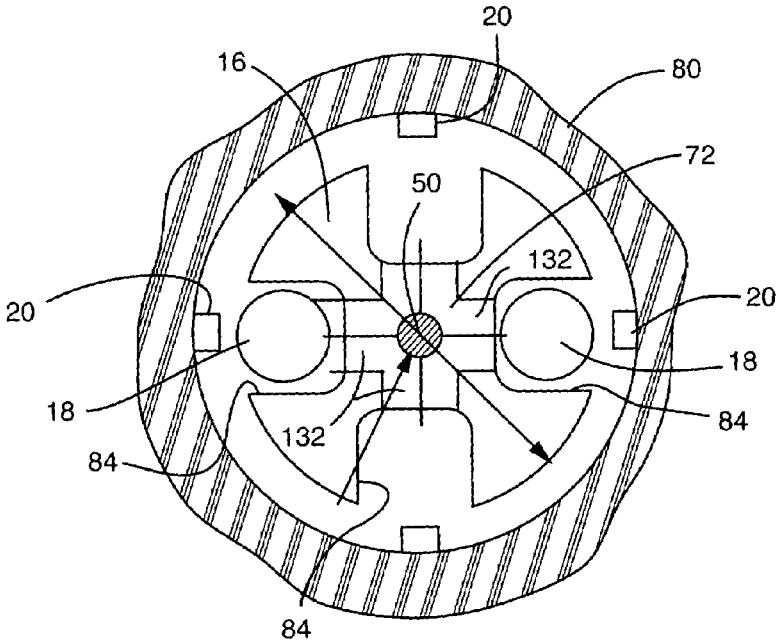
FIG. 13 is an enlarged horizontal sectional view taken generally on the line 13—13 of FIG. 3.
Figure 15:
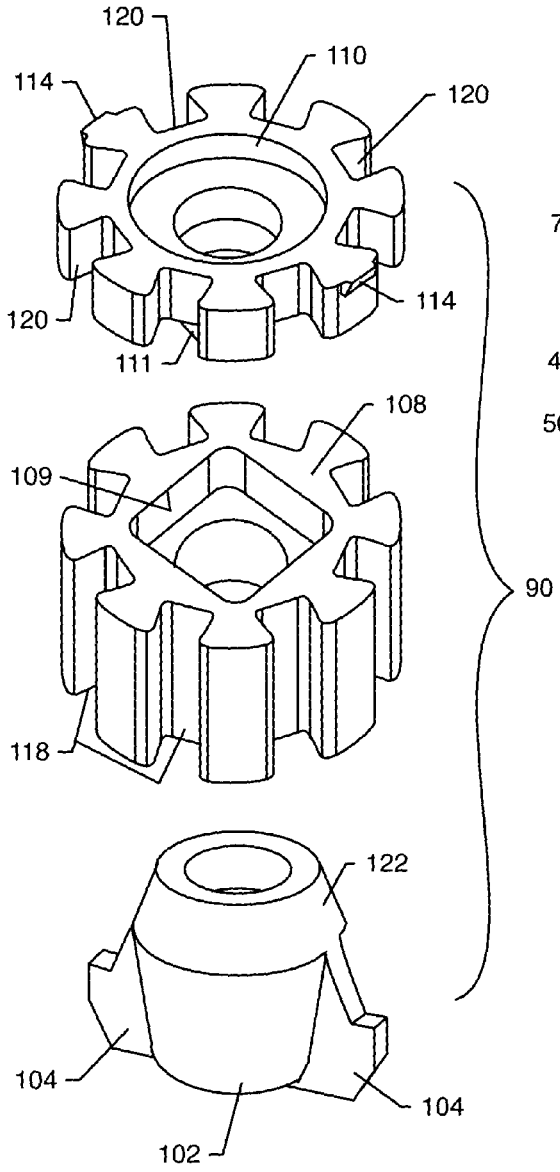
FIG. 15 is an enlarged and exploded perspective view showing components of an adjustable flow control assembly for the sprinkler.

The ball drive rotor 16 may also be formed from molded plastic or the like and is mounted onto an upper end of the drive shaft 50 for rotation therewith at an upper surface of the deflector 12. FIGS. 12–14 show the ball drive rotor 16 in one preferred form to include a generally disk-shaped element having a central hub 72 secured as by press-fit or snap-fit mounting onto an upper segment of the drive shaft 50 for rotatable driving therewith, with an upper end of the drive shaft being axially slidably and rotatably positioned within a central recess 74 (FIG. 3) formed at the underside of a cap plate 76. The cap plate 76 is in turn seated at its periphery as by press-fit or snap-fit seated reception into a shallow counterbore 78 formed at the upper margin of a generally cylindrical wall 80 upstanding from the periphery of the deflector upper surface and the periphery of the underside vane array 28. As shown best in FIG. 3, the upper side of the deflector 12 cooperates with the deflector wall 80 and the cap plate 76 to define a substantially enclosed drive chamber 82 within which the drive rotor 16 is positioned.

The drive rotor 16 includes at least one and preferably a plurality of radially outwardly open slotted tracks 84, with four of said slotted tracks 84 being shown in FIGS. 12–13 formed at substantially equiangular intervals. At least one and preferably multiple drive balls 18 are rollably carried within these tracks 84 for centrifugal displacement in response to rotatable driving of the drive rotor 16. In this regard, each drive ball 18 has a substantial mass, as by forming the drive balls from steel or stainless steel or the like. In addition, the perimeter of the drive rotor 16 is radially spaced from the deflector wall 80 by a clearance sufficient to accommodate free rotor rotation relative to the deflector, but such clearance is insufficient to permit escape of the drive ball 18 from its associated track 84. Similarly, the vertical dimension of the drive chamber 82 is also insufficient to permit drive ball escape from the associated track 84. In the illustrative drawings (FIG. 13), two drive balls 18 are positioned respectively within a diametrically opposed pair of the slotted tracks 84, to provide a balanced rotary structure. Persons skilled in the art will appreciate, however, that any number of drive balls 18 and a corresponding number of slotted tracks 84 may be used, with a preferred arrangement including multiple drive balls arranged in a balanced array about the rotational axis of the drive shaft 50.

The upper surface of the deflector 12, within the drive chamber 82, includes an inclined ramp 86 extending radially outwardly and axially upwardly from the central deflector hub 66 toward the peripheral wall 80. Each drive ball 18 is rollingly supported on this inclined ramp 86, whereby each drive ball 18 normally rolls down this ramp in a radially inward direction along the associated slotted track 84 when the rotor 16 is stationary. However, upon rotational driving of the rotor 16 at a speed capable of generating a sufficient centrifugal force, each drive ball 18 is displaced by centrifugal action in a radially outward direction along the associated track 84.

When this occurs, each drive ball 18 moves into rolling contact against an interior surface of the deflector wall 80. In accordance with one aspect of the invention, the wall surface incorporates at least one and preferably multiple radially inwardly protruding anvils 20. As the rotor 16 is driven at a sufficient speed, the drive balls 18 are thus rotationally carried into impact engagement with the anvils 20, with the resultant impact force being effective to rotate the deflector 12 through a small rotary step or increment of a few degrees. Following such impact, the drive ball 18 is displaced radially inwardly a sufficient distance to clear the impacted anvil 20 by the combined effect of ball rebound and interrupted rotor speed to produce insufficient centrifugal force to maintain each drive ball 18 in the radially outermost position. As a result, the step-rotated deflector 12 momentarily ceases rotation and remains stationary for a brief interval until resumed rotor rotation again carries a drive ball 18 by centrifugal action to the radially outermost position for impact engagement with an anvil 20. The drive ball or balls 18 repeated and rapidly strike the anvil or anvils 20 at a regular impact frequency for rotatably driving the deflector 12 in a rapid succession of small rotational steps, thereby sweeping the projected water streams 14 over the surrounding terrain area in a similar rapid succession of small rotational steps.

The speed control brake 22 comprises a relatively simple yet highly effective structure for frictionally resisting rotational displacement of the deflector 12, thereby assuring step-wise rotation in relatively small increments of substantially uniform angular displacement. As shown, the speed control brake 22 comprises an annular brake pad 88 formed from a suitable brake material such as a resilient silicone-based elastomer or the like interposed axially between the deflector hub 66 and the thrust flange 70 on the bearing sleeve 54. In this regard, the deflector hub 66 defines an axially upwardly presented friction surface 89 (shown best in FIG. 16) rotatable with the deflector 12, whereas the thrust flange 70 defines an axially downwardly presented brake disk carried by the bearing sleeve 54 and thereby constrained against rotation.

Figure 3:
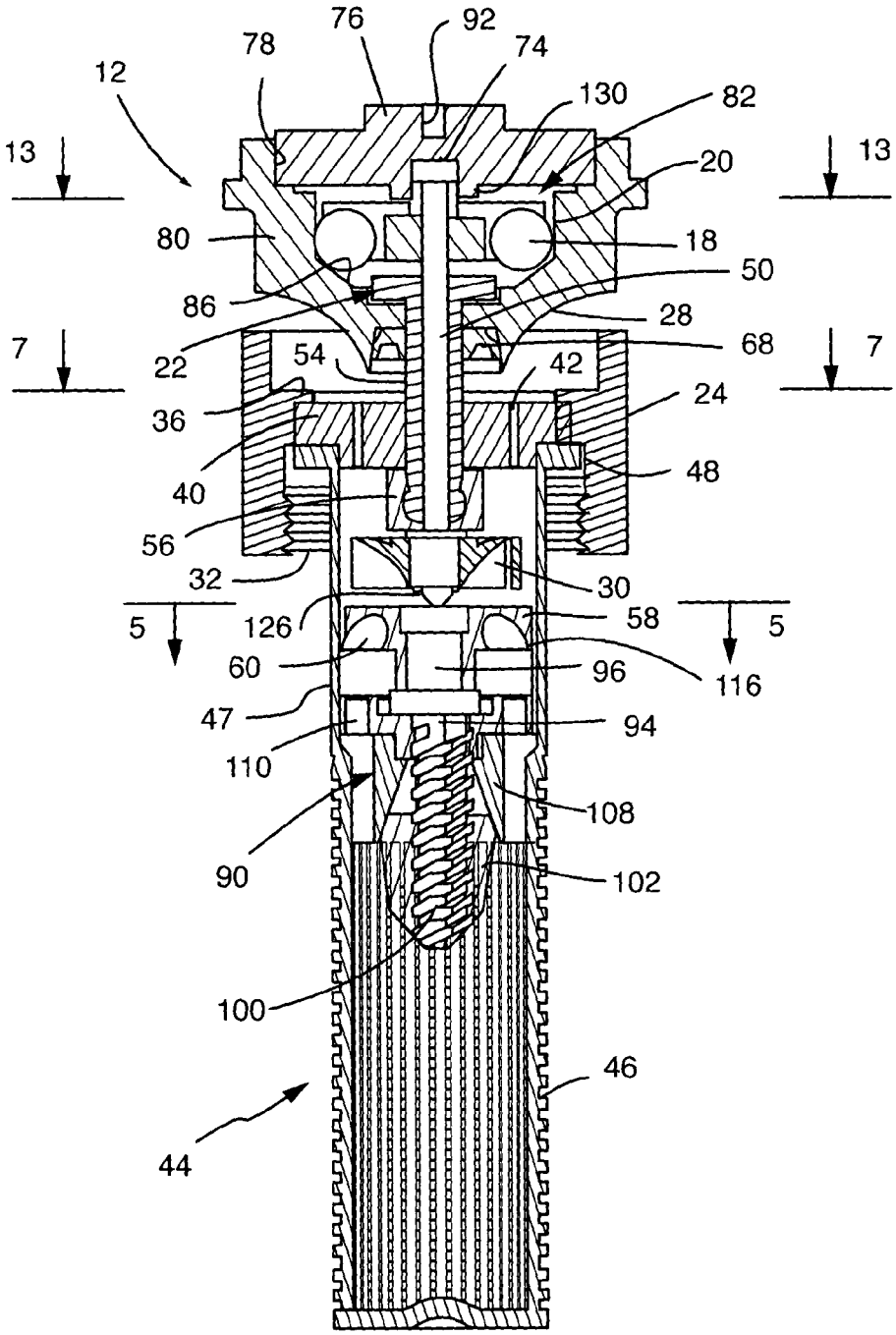
FIG. 3 is an enlarged vertical sectional view taken generally on the line 3—3 of FIG. 1.
Figure 4:
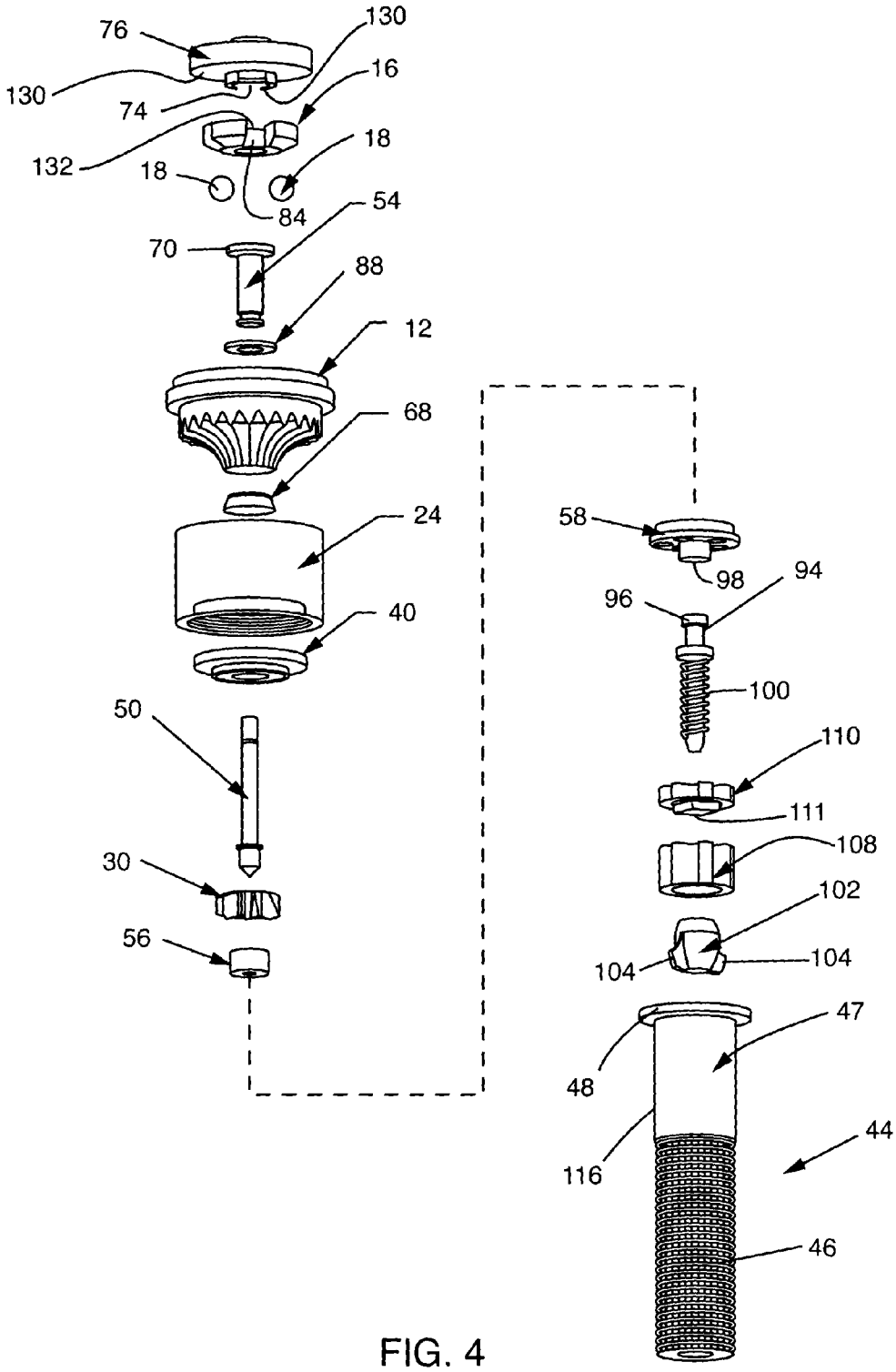
FIG. 4 is an exploded perspective view of the rotating stream sprinkler.

When water under pressure is supplied to the sprinkler, the upwardly directed jet or jets impinging upon the vanes 28 provide a thrust force urging the deflector 12 axially upwardly through a short stroke to compress the brake pad 88 between the deflector hub 66 and the thrust flange 70 (as viewed in FIG. 3). The magnitude of this upward thrust force varies in direct proportion to variations in water supply pressure and/or water flow rate. In this regard, in the most preferred form, the contact surfaces of the brake pad 88 with the friction surface 89 (FIGS. 10, 11 and 16) on the deflector hub 66 and the axially underside surface of the thrust flange 70 are shaped for variably adjusting the surface contact radius in response to fluctuations in water supply pressure and/or flow rate which can occur in the course of any given cycle of sprinkler operation, to achieve a substantially constant speed of deflector rotation despite such pressure and/or flow rate fluctuations within a normal operating range. In this regard, the brake pad 88 preferably includes a tapered profile for varying the radius of surface contact to correspondingly vary the friction brake torque substantially as a linear function of changes in water pressure and flow rate. This brake pad geometry, and functional alternatives, is shown and described in copending U.S. Ser. No. 10/310,584, filed Dec. 4, 2002, which is incorporated by reference herein.

The specific design parameters of the sprinkler components can be selected to achieve a target and substantially constant deflector rotational speed within a desired and relatively slow speed range on the order of about 4–20 rpm. In this regard, the turbine 30 can be designed in conjunction with the ball drive rotor 16 and associated drive balls 18 for rotatably driving the rotor at a relatively high rate of speed, such as about 350–400 rpm. The angle of the inclined ramp 86 on the deflector 12 can be selected in relation to ball mass to achieve radially outward ball displacement by centrifugal force when rotor rotation exceeds a predetermined speed, such as about 325–350 rpm. By selecting the number of drive balls 18 and associated number of anvils 20, a target frequency of ball-anvil impact engagement can be obtained, such as about 360 impacts per minute. Finally, by appropriately designing the speed control brake 20 to provide a predetermined frictional resistance to deflector rotation, the angular increment of each deflector step can be obtained, such as about 4° per step increment to yield a deflector rotational speed of about 4 rpm. With this arrangement, the deflector 12 is rotatably driven in a rapid succession of step-wise increments, the deflector rotation being briefly interrupted after each rotational step for a time period sufficient for the outwardly projected water streams 14 to achieve a substantially maximized projected range.

A flow rate adjustment assembly 90 (FIGS. 3–4 and 15–16) may be provided for selectively setting the water flow rate through the sprinkler 10, for purposes of regulating the range of throw of the projected water streams 14. As shown, this flow rate adjustment assembly 90 is mounted within the filter unit 44 at an upstream location relative to the swirl plate 58. Conveniently, the flow rate adjustment assembly 90 is adapted for variable setting by means of a screwdriver 91 (FIG. 16) or the like engageable with a screwdriver slot 92 or the like formed in an upwardly exposed surface of the cap plate 76 (FIGS. 3 and 16).

The illustrative flow rate adjustment assembly 90 includes an adjustment screw 94 having a head 96 rotatably carried and axially retained by a cylindrical hub 98 of the swirl plate 58. A threaded screw shank 100 is suspended from the head 96 to project downwardly into the interior of the filter unit 44, in an upstream direction extending away from the swirl plate 58. A flow rate adjustment nut 102 is threaded carried on the shank 100 and includes at least one and preferably multiple radially outwardly extending wings 104 (FIG. 15) engages with internal ribs or splines 106 (FIG. 16) formed within the perforated lower side wall segment 46. Accordingly, rotation of the screw head 96 and associate shank 100 is accompanied by axial translation of the flow rate adjustment nut 102, without nut rotation on the screw.

Figure 16:
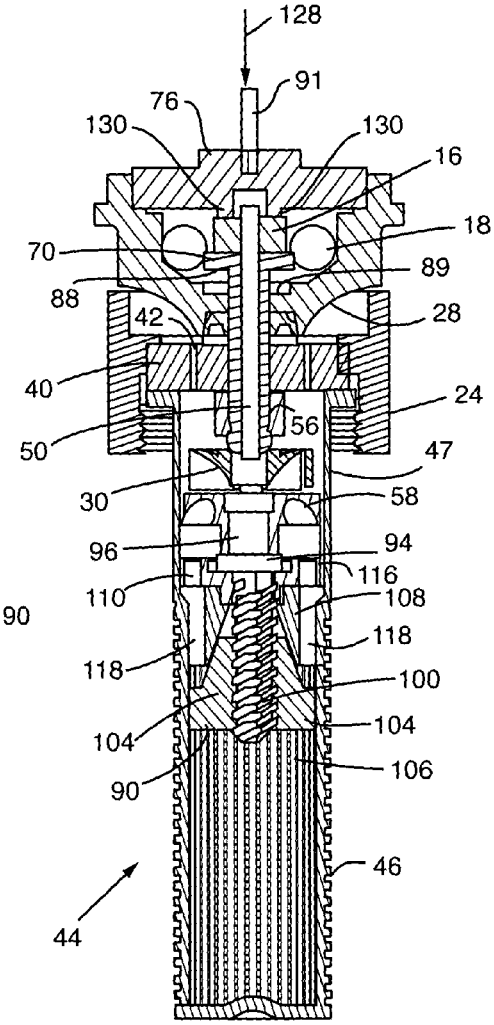
FIG. 16 is an enlarged sectional view similar to FIG. 3, but depicting adjustment of the flow control assembly.

A resilient flow rate restrictor element 108 is captured between the flow rate adjustment nut 102 and a support disk 110 seated axially against a backstop flange 112 formed on the screw head 96 (FIGS. 3 and 16). In addition, this support disk 110 may also include a pair of outwardly radiating ears 114 (shown best in FIG. 15) for snap-fit reception into a corresponding pair of side ports 116 (FIGS. 2–3) formed in the imperforate upper side wall segment 47 of the filter unit 44. As shown, the support disk 110 includes a downwardly protruding nose 111 (FIG. 4) of noncircular geometry for seated reception into a matingly shaped noncircular seat 109 (FIG. 15) formed in an upper side of the restrictor element 108 to rotationally align and retain these components with respect to each other. Importantly, the restrictor element 108 includes a plurality of peripheral flow channels or slots 118 (FIGS. 15–16) which are respectively aligned axially with a corresponding plurality of peripheral flow channels or slots 120 formed in the support disk 110. These aligned flow channels 118, 120 accommodate upward water flow past the flow rate adjustment assembly 90 and further to the swirl plate 58 for normal sprinkler operation.

However, the flow rate of water through these channels 118, 120 can be selectively throttled or reduced by rotating the adjustment screw 94 in a direction translating the adjustment nut 102 in an upward direction to compress the restrictor element 108. Such adjustment is illustrated in FIG. 16 which shows a conically tapered upper surface 122 on the nut 102 bearing against a matingly tapered lower surface 123 on the restrictor element 108, to cause a side wall of the restrictor element 108 to bulge radially outwardly as indicated by arrows 124, resulting in restriction of the cross sectional areas of the flow channels 118 and a corresponding restriction or reduction in water flow rate past the adjustment assembly 90.

The head 96 of the adjustment screw 94 includes an upwardly presented slotted recess 125 (FIG. 5) which is normally positioned in axially spaced relation below the turbine 30. That is, upon normal supply of water under pressure to the sprinkler, upwardly directly water flow acts against the turbine 30 and the vaned underside surface of the deflector 12 to urge the turbine 30 and deflector 12 together with the drive shaft 50 upwardly through a short axial stroke to a normal first position with the speed control brake components are axially engaged. In this normal operating position, as viewed in FIG. 3, a lower end of the drive shaft 50 including a tool member, e.g., a slotted tool tip 126 such as a Phillips-type screwdriver tip, is axially spaced above the swirl plate 58 to permit unimpeded rotation of the drive shaft 50 and components mounted thereon.

However, when the screwdriver 91 or other suitable tool is engages with the cap plate slot 92 and pressed downwardly, as depicted by arrow 128 in FIG. 16, the cap plate 76 is translated axially downwardly through a short stroke into engagement with an upper side of the ball drive rotor 16. Importantly, the underside surface of the cap plate 76 includes one or more downwardly protruding keys 130 (FIGS. 3, 4 and 16) for engaging the axially upwardly open and matingly shaped keyways 132 (FIGS. 3, 12–14 and 16) formed in the hub 72 of the ball drive rotor 16. At the same time, continued downward pressure applied to the cap plate 76 shifts the deflector 12 downwardly to disengage the speed control brake components (FIG. 16) and also shifts the drive shaft 50 downwardly a sufficient distance to engage the tool tip 126 with the tool recess 125 formed in the head 96 of the flow rate adjustment screw 94.

In this downwardly shifted or second position, subsequent rotational movement of the screwdriver 91 will impart a corresponding rotational motion via the rotor 16 to the drive shaft 50 and the associated tool tip 126 thereon, for rotatably adjusting the position of the flow rate adjustment screw 94, thereby variably altering the water flow rate to and through the sprinkler 10. When a desired adjustment setting is reached, the tool 91 is removed and subsequent resumption of water supply under pressure to the sprinkler automatically shifts the turbine 30 and the deflector 12 with the drive shaft 50 upwardly within the bearing sleeve 54 to disengage the cap plate keys 130 from the keyways 132 on the ball drive rotor 16, and also to disengage the drive shaft tool tip 126 from the flow rate adjustment screw 94. At the same time, this upward water pressure acting on the deflector 12 returns the components of the speed control brake into engagement for resumed speed control function.

With this arrangement, the specific water flow rate to and through the sprinkler 10 can be quickly and easily set. Thereafter, water under pressure supplied via the riser 26 flows through the swirl plate 58 for rotatably driving the turbine 30, which in turn rotatably drives the rotor 16 and associated drive ball or balls 18. As the water flow continues upwardly through the pattern plate 40 to impinge upon the deflector vanes 28, for outward projection in the form of the relatively small water streams 14, the drive ball or balls 18 repetitiously impact the anvil or anvils 20 for rotatably driving the deflector 12 is a succession of small rotary steps. As a result, the streams 14 are swept in a stepwise fashion over the surrounding terrain. The speed control brake 22 advantageously maintains the rotational speed of the deflector 12 at a relatively slow and substantially constant flow rate throughout a normal range of water supply pressures and flow rates, to achieve highly uniform and consistent distribution of irrigation water.

A variety of further modifications and improvements in and to the rotating stream sprinkler of the present invention will be apparent to those persons skilled in the art. Accordingly, no limitation on the invention is intended by way of the foregoing description and accompanying drawings, except as set forth in the appended claims.

What is claimed is:

1. A rotating stream sprinkler, comprising:

a rotatable deflector having an underside surface defining an array of vanes and an upper surface defining a radially outwardly inclined ramp;

at least one jet port for directing at least one water jet into engagement with said vanes, said vanes subdividing and redirecting said at least one water jet into a plurality of relatively small water streams projected generally radially outwardly therefrom;

a ball drive rotor mounted for rotation relative to said deflector and having at least one radially outwardly open ball track formed therein;

each of said at least one ball track having a drive ball movably carried therein and supported on said inclined ramp, said drive ball having a size and mass for radially outward displacement along said ball track by centrifugal force in response to rotor rotation exceeding a predetermined rotational speed;

at least one anvil carried by said deflector for repetitious impact engagement by said drive ball upon rotor rotation exceeding said predetermined rotational speed for rotatably displacing said deflector through a repetitious succession of relatively small rotational step; and a turbine drive arrangement for rotatably driving said rotor at a rotational speed exceeding said predetermined rotational speed.

2. The rotating stream sprinkler of claim 1 further including a speed control brake coupled to said deflector and including friction members for resisting rotation of said deflector variably in response to fluctuations in water supply pressure and flow rate to maintain deflector rotational speed substantially constant throughout a normal operating range of water pressures and flow rates.

3. The rotating stream sprinkler of claim 1 wherein said array of vanes on said deflector underside surface comprises a plurality of vanes extending generally upwardly and curving smoothly to extend generally radially outwardly with a selected angle of inclination, said plurality of vanes defining a corresponding plurality of intervening flow channels.

4. The rotating stream sprinkler of claim 1 wherein said deflector and said ball drive rotor are supported for rotation about a common axis.

5. The rotating stream sprinkler of claim 1 further including a sprinkler base adapted for mounting onto an upper end of a tubular riser adapted in turn for connection to a supply of water under pressure, said base having said deflector and said ball drive rotor rotatably supported thereon, said at least one jet port being formed in said base.

6. The rotating stream sprinkler of claim 5 wherein said at least one jet port formed in said base is formed in a predetermined configuration to provide a predetermined pattern of water streams projected outwardly from said deflector.

7. The rotating stream sprinkler of claim 1 wherein said at least one ball track formed in said ball drive rotor comprises a plurality of said ball tracks formed generally at equiangularly spaced positions, and further wherein each of said plurality of ball tracks has a respective drive ball carried therein.

8. The rotating stream sprinkler of claim 1 wherein said at least one anvil comprises a plurality of anvils carried by said deflector generally at equiangularly spaced positions.

9. The rotating stream sprinkler of claim 1 further including a generally cylindrical wall upstanding from the periphery of said deflector upper surface, said at least one anvil protruding radially inwardly from said wall.

10. The rotating stream sprinkler of claim 9 further including a cap plate mounted on said wall and cooperating with said wall and said deflector upper surface to define a substantially closed drive chamber having said rotor and said drive ball contained therein.

11. The rotating stream sprinkler of claim 1 further including a cap member for retaining said drive ball within said ball track.

12. The rotating stream sprinkler of claim 1 wherein said turbine drive arrangement comprises a water turbine, a drive shaft rotatably connecting said turbine with said rotor, and a swirl plate having at least one swirl port formed therein for providing a circumferentially swirling water flow for rotatably driving said turbine.

13. The rotating stream sprinkler of claim 12 wherein said swirl plate and said turbine are mounted upstream relative to said at least one water jet.

14. The rotating stream sprinkler of claim 12 further including a bearing sleeve rotatably supporting said drive shaft and having said deflector independently rotatably supported thereon, said bearing sleeve including a radially enlarged thrust flange, and further including a brake pad axially interposed between said thrust flange and a friction surface on said deflector for frictionally resisting deflector rotation.

15. The rotating stream sprinkler of claim 2 wherein said speed control brake comprises a friction surface on said deflector, a substantially nonrotational brake disk, and a resilient brake pad interposed between said friction surface and said brake disk.

16. The rotating stream sprinkler of claim 1 further including a flow rate adjustment assembly for variably adjusting water flow to the sprinkler.

17. The rotating stream sprinkler of claim 16 wherein said flow rate adjustment assembly comprises a rotatable adjustment screw, an adjustment nut axially translatable on said screw upon rotation thereof, and a resilient restrictor element having at least one flow channel formed therein, said restrictor element being compressible by said nut upon rotation of said screw for varying the cross sectional size of said at least one flow channel thereby variably throttling water flow to the sprinkler.

18. The rotating stream sprinkler of claim 17 wherein said flow rate adjustment assembly is mounted upstream relative to said turbine drive arrangement.

19. The rotating stream sprinkler of claim 17 further including a generally cup-shaped filter unit having said flow adjustment assembly mounted therein.

20. The rotating stream sprinkler of claim 17 further including means for engaging and rotating said adjustment screw from the exterior of the sprinkler.

21. A rotating stream sprinkler, comprising:

a base adapted for mounting onto an upper end of a tubular riser adapted in turn for connection to a supply of water under pressure;

a deflector rotatably mounted on said base, said deflector having an underside surface defining an array of vanes disposed in spaced relation above said base, said array of vanes extending generally upwardly relative to said base and then curving smoothly to extend generally radially outwardly with a selected angle of inclination, said plurality of vanes defining a corresponding plurality of intervening flow channels, said deflector further including an upper surface defining a radially outwardly inclined ramp;

at least one jet port formed in said base for directing at least one water jet generally upwardly into engagement with said vanes, said vanes subdividing and redirecting said at least one water jet into a plurality of relatively small water streams projected generally radially outwardly therefrom;

a ball drive rotor mounted for rotation relative to said deflector and having at least one radially outwardly open ball track formed therein;

each of said at least one ball track having a drive ball movably carried therein and rollingly supported on said inclined ramp, said drive ball having a size and mass for radially outward displacement along said ball track by centrifugal force in response to rotor rotation exceeding a predetermined rotational speed;

a generally cylindrical wall upstanding from the periphery of said deflector upper surface;

at least one anvil protruding generally radially inwardly from said wall for repetitious impact engagement by said drive ball upon rotor rotation exceeding said predetermined rotational speed for rotatably displacing said deflector through a repetitious succession of relatively small rotational step; and a turbine drive arrangement for rotatably driving said rotor at a rotational speed exceeding said predetermined rotational speed.

22. The rotating stream sprinkler of claim 21 further including a speed control brake coupled to said deflector and including friction members for resisting rotation of said deflector variably in response to fluctuations in water supply pressure and flow rate to maintain deflector rotational speed substantially constant throughout a normal operating range of water pressures and flow rates.

23. The rotating stream sprinkler of claim 21 wherein said deflector and said ball drive rotor are supported by said base for rotation about a common axis.

24. The rotating stream sprinkler of claim 21 wherein said turbine drive arrangement comprises a water turbine, and a drive shaft connected between said turbine and said rotor, and further including a bearing sleeve rotatably supporting said drive shaft and carrying said deflector for independent rotation relative to said drive shaft.

25. The rotating stream sprinkler of claim 24 wherein said bearing sleeve further includes a radially enlarged thrust flange, and further including a brake pad axially interposed between said thrust flange and a friction surface on said deflector for frictionally resisting deflector rotation.

26. The rotating stream sprinkler of claim 21 wherein said at least one ball track formed in said ball drive rotor comprises a plurality of said ball tracks formed generally at equiangularly spaced positions, and further wherein each of said plurality of ball tracks has a respective drive ball carried therein.

27. The rotating stream sprinkler of claim 21 wherein said at least one anvil comprises a plurality of anvils carried by said wall generally at equiangularly spaced positions.

28. The rotating stream sprinkler of claim 21 wherein said wall is formed integrally with said deflector.

29. The rotating stream sprinkler of claim 21 further including a cap plate mounted on said wall and cooperating with said wall and said deflector upper surface to define a substantially closed drive chamber having said rotor and said drive ball contained therein.

30. The rotating stream sprinkler of claim 24 wherein said turbine drive arrangement further comprises a swirl plate positioned upstream relative to said at least one jet port, said swirl plate having at least one swirl port formed therein for providing a circumferentially swirling water flow for rotatably driving said turbine.

31. The rotating stream sprinkler of claim 21 further including a flow rate adjustment assembly for variably adjusting water flow to the sprinkler.

32. The rotating stream sprinkler of claim 31 wherein said flow rate adjustment assembly comprises a rotatable adjustment screw, an adjustment nut axially translatable on said screw upon rotation thereof, and a resilient restrictor element having at least one flow channel formed therein, said restrictor element being compressible by said nut upon rotation of said screw for varying the cross sectional size of said at least one flow channel thereby variably throttling water flow to the sprinkler.

33. The rotating stream sprinkler of claim 32 wherein said turbine drive arrangement comprises a water turbine and a drive shaft connected between said water turbine and said rotor, and further including a cap plate mounted on said wall and cooperating with said wall and said deflector upper surface to define a substantially closed drive chamber having said rotor and said drive ball contained therein, said cap plate having an externally exposed tool slot formed therein and further including at least one key engageable with said rotor for rotatably driving said rotor upon rotation of said cap plate, and said drive shaft having a tool tip engageable with said adjustment screw for rotating said screw, said drive shaft being supported during normal operation with said cap plate key in spaced relation with said rotor and with said tool tip in spaced relation to said adjustment screw, said cap plate being movable axially for engaging said cap plate key with said rotor and for engaging said tool tip with said adjustment screw and thereupon rotatable for rotatably adjusting said adjustment screw.

34. The rotating stream sprinkler of claim 33 wherein said drive shaft is supported during normal operation by the pressure of water supplied to the sprinkler with said cap plate key in spaced relation with said rotor and with said tool tip in spaced relation to said adjustment screw.

35. The rotating stream sprinkler of claim 31 wherein said flow rate adjustment assembly is mounted upstream relative to said turbine drive arrangement.

36. The rotating stream sprinkler of claim 35 further including a generally cup-shaped filter unit having said flow adjustment assembly mounted therein.

37. A rotating stream sprinkler, comprising:

a rotatable deflector having an underside surface defining an array of vanes and an upper surface defining a radially outwardly inclined ramp;

at least one jet port for directing at least one water jet into engagement with said vanes, said vanes subdividing and redirecting said at least one water jet into a plurality of relatively small water streams projected generally radially outwardly therefrom;

a drive rotor for rotatably driving said deflector;

a turbine drive arrangement including a turbine, a drive shaft rotatably connecting said turbine with said rotor for rotatably driving said rotor, and a swirl plate having at least one swirl port formed therein for providing a circumferentially swirling water flow for rotatably driving said turbine; and a flow rate adjustment assembly for variably adjusting water flow to the sprinkler, said flow rate adjustment assembly including a rotatable adjustment screw, an adjustment nut axially translatable on said screw upon rotation thereof, and a resilient restrictor element having at least one flow channel formed therein, said restrictor element being compressible by said nut upon rotation of said screw for varying the cross sectional size of said at least one flow channel thereby variably throttling water flow to the sprinkler;

said drive shaft further including a tool member engageable with said adjustment screw for rotatably adjusting said screw, said drive shaft being axially movable between a first position with said tool member in spaced relation with said adjustment screw and a second position with said tool member engaged with said adjustment screw, said drive shaft being normally supported in said first position during normal operation by the pressure of water supplied to the sprinkler.

38. The rotating stream sprinkler of claim 37 wherein said flow rate adjustment assembly is mounted upstream relative to said turbine drive arrangement.

39. The rotating stream sprinkler of claim 37 further including a speed control brake coupled to said deflector and including friction members for resisting rotation of said deflector variably in response to fluctuations in water supply pressure and flow rate to maintain deflector rotational speed substantially constant throughout a normal operating range of water pressures and flow rates, said friction members being engaged when said drive shaft is in said first position and disengaged when said drive shaft is in said second position.

40. The rotating stream sprinkler of claim 37 further including a cap plate mounted on said deflector, said cap plate being movable axially for engaging and shifting said drive shaft from said first position to said second position, said cap plate further including at least one key engageable with at least one keyway formed in said rotor for rotatably driving said rotor upon rotation of said cap plate when said drive shaft is in said second position, for rotatably driving said adjustment screw.

41. The rotating stream sprinkler of claim 40 wherein said cap plate has an externally exposed tool slot formed therein.

* * * * *